US006308868B1

(12) United States Patent
Hoffman et al.

(10) Patent No.: US 6,308,868 B1
(45) Date of Patent: Oct. 30, 2001

(54) HIGH PRESSURE CARTRIDGE FEED SYSTEM

(75) Inventors: Alexander M. Hoffman; Kenneth L. Miller, both of Indianapolis, IN (US)

(73) Assignee: Liquid Control Corporation, North Canton, OH (US)

( * ) Notice: Subject to any disclaimer, the term of this patent is extended or adjusted under 35 U.S.C. 154(b) by 0 days.

(21) Appl. No.: 09/665,831

(22) Filed: Sep. 20, 2000

Related U.S. Application Data

(60) Provisional application No. 60/154,848, filed on Sep. 20, 1999.

(51) Int. Cl.[7] ..... B67D 5/42
(52) U.S. Cl. ..... 222/389; 222/334; 222/153.01
(58) Field of Search ..... 222/334, 333, 222/326, 327, 389, 153.01

(56) References Cited

U.S. PATENT DOCUMENTS 1,709,445 * 4/1929 Tomes ..... 222/334
2,131,488 * 9/1938 Tear ..... 222/334
2,692,706 * 10/1954 Wiksten ..... 222/334
4,067,479 * 1/1978 Moline ..... 222/334
4,974,752 * 12/1990 Sirek ..... 222/334
5,020,693 * 6/1991 Ernst et al. ..... 222/334
5,875,928 * 3/1999 Muller et al. ..... 222/334
6,082,597 * 7/2000 Beckett et al. ..... 222/334

* cited by examiner

*Primary Examiner*—Philippe Derakshani
*Assistant Examiner*—Thach H Bui
(74) *Attorney, Agent, or Firm*—Sand & Sebolt

(57) ABSTRACT

The high pressure cartridge feed system of the invention includes a cradle that supports the material cartridge so that the cartridge will not fail at the high dispensing pressures. A powered ram assembly drives a ram head into the cartridge to create the high dispensing pressure. The cartridge is supported on all sides to prevent failure. A smooth connection fitting is provided to allow cartridges to be quick changed. The cradle is pivotably mounted to allow the cartridge to be loaded in a substantially horizontal position. In one embodiment, the cradle is removable.

25 Claims, 15 Drawing Sheets

HIGH PRESSURE CARTRIDGE FEED SYSTEM

CROSS REFERENCE TO RELATED APPLICATION

This application claims priority from U.S. patent application Ser. No. 60/154,848, filed Sep. 20, 1999; the disclosures of which are incorporated herein by reference.

BACKGROUND OF THE INVENTION

1. Technical Field

The present invention is generally related to dispensing devices and, more particularly, to a cartridge dispensing system that facilitates higher material feed pressures than those in the prior art. Specifically, the present invention uses a cartridge retainer having a containment bore that substantially matches the cartridge so that the walls forming the containment bore support the cartridge when high pressure is applied by a pneumatic piston that seals the end of the cartridge.

2. Background Information

Various types of liquids, pastes, lubricants, sealants, gasketing compounds, and potting compounds, as well as other materials are sold in standard cartridges that are used in cooperation with dispensing devices to allow the user to dispense the material from the cartridge. These cartridges are typically plastic and are substantially cylindrical in shape with a threaded outlet port on one end and an open end on the opposite end. These cartridges include 2.5, 6, 12, 20, and 32 ounce sizes; 300 and 500 ml sizes; as well as 1/10 gallon sizes. The cartridges typically include a plunger that seals the open end of the cartridge. In the past, a ram is placed in the open end of the cartridge against the plunger to form a seal within the bore of the cartridge to push the material toward the outlet port. The pressure from the ram pressurizes the contents of the cartridge causing the material to flow from the outlet port. An outlet fitting is typically threaded onto the cartridge at the outlet port to allow the material to be routed to the necessary location.

There are two standard methods for generating pressure within known cartridges. Each of these methods hold the cartridge statically while force is generated on the ram. Force is generated in the first method by using a compressed gas. The second method uses a drive rod that is mechanically moved by an actuator.

The major limitation in current cartridge and dispensing device design is that they cannot reliably generate material pressures within the cartridge of greater than approximately 100 pounds per square inch. This limitation often causes problems when a cartridge contains a material with a high viscosity. Examples of these materials are heavy bodied greases and paste adhesives. The problem with the low pressure is that the flow rate of the material from the cartridge is too low to be desired in the art. It is thus desired in the art to provide a cartridge dispensing system that allows higher viscosity materials to be dispensed at a greater flow rate by providing higher pressure within the cartridge.

Simply applying a higher pressure to the cartridges in past dispensing devices resulted in two problems. First, the cartridge plunger formed a relatively loose seal with the cartridge allowing the material to leak back out around the plunger and the ram. Second, the cartridge was held in the dispensing device with a relatively loose fit. A sufficiently high enough pressure would cause the sidewall of the cartridge to fail because of the loose fit.

Another problem with current dispensing systems is that there is a relatively large amount of time and effort required to change a cartridge. Cartridges are typically loaded into a containment bore from one end requiring a sealed end cap to be removed or the drive rod to be completely retracted from the cartridge. Another problem is that the outlet port fitting must be unthreaded from the old cartridge and threaded into the new cartridge. These steps result in downtime and can contribute to material spillage and air entrapment in the material. It is thus desired in the art to provide a dispensing device that allows cartridges to be changed in and out of the device relatively easily. Another problem with the prior art is that a partially-used cartridge may need to be refrigerated between uses. The art desires a dispensing mechanism that allows a partially-used cartridge to be readily removed and stored in a different location without unsealing the contents of the cartridge.

SUMMARY OF THE INVENTION

In view of the foregoing, it is an objective of the present invention to provide a cartridge dispensing system having the ability to use high pressure used to create a high dispensing flow rate.

Another objective of the present invention is to provide a high pressure cartridge feed system that has a split containment bore that can be longitudinally opened to allow the cartridges to be easily inserted and removed.

Another objective of the present invention is to provide a split containment bore having first and second longitudinal halves connected by a hinge that allows the halves to be pivoted from an opened position to a closed position.

Another objective of the present invention is to provide a cartridge feed system that includes a clamp that positively holds the halves together to create pressure on the cartridge within the system.

Another objective of the invention is to provide a containment bore that encircles a cartridge to provide a support force about the periphery of the cartridge.

Another objective of the present invention is to provide a cartridge feed system having an interlock that prevents dispensing unless the cartridge is locked in place.

Another objective of the present invention is to provide a high pressure cartridge feed system having a push rod with a ram head that seals the bore of the cartridge to prevent leaking.

Another objective of the present invention is to provide a high pressure cartridge feed system that includes an outlet port fitting that is not threaded to the cartridge so that it may be readily removed and replaced on a new cartridge.

Another objective of the present invention is to provide a high pressure cartridge feed system having a base that pivots down to pivot the old cartridge toward horizontal to allow for easy removal.

Another objective of the present invention is to provide a high pressure cartridge feed system having a rigid outlet fitting connection to prevent the cartridge from cracking or failing at the outlet port.

Another objective of the present invention is to provide a high pressure cartridge feed system having a material level sensor so that the user can determine when the cartridge is almost empty.

Another objective of the invention is to provide a outlet fitting that does not have to be threaded to the cartridge so that the cartridge may be installed and removed quickly.

A further objective of the present invention is to provide a high pressure cartridge feed system that is of simple construction, that achieves the stated objectives in a simple, effective, and inexpensive manner, that solves the problems and that satisfies the needs existing in the art.

These and other objectives and advantages of the present invention are achieved by the a cartridge dispensing system for dispensing material out of a cartridge, the system including a base; a ram assembly including at least one linear actuator and a ram head; a cradle carried by the base; the cradle adapted to hold the cartridge; and the linear actuator adapted to cause the ram head to engage the cartridge and push material out of the cartridge.

Other objectives and advantages of the invention are achieved by a cartridge dispensing system for dispensing material out of a cartridge, the cartridge including a cylindrical wall having an open end; the system including a base; a ram assembly including a ram head adapted to fit within the open end of the cartridge; the ram head including an annular seal adapted to seal the open end of the cartridge; the ram head including a ram base that carries the annular seal and a ram nose that is movable between engaged and disengaged positions; a cradle carried by the base; the cradle adapted to hold the cartridge; and the ram assembly adapted to cause the ram head to engage the cartridge and push material out of the cartridge.

Further objectives and advantages of the invention are achieved by a cartridge dispensing system for dispensing material out of a cartridge, the system including a base; a ram assembly a ram head; a cradle carried by the base; the cradle adapted to hold the cartridge; the cradle pivoting between dispensing and loading positions; and the ram assembly adapted to cause the ram head to engage the cartridge and push material out of the cartridge.

BRIEF DESCRIPTION OF THE DRAWINGS

The preferred embodiments of the invention, illustrative of the best mode in which applicant contemplated applying the principles of the invention, are set forth in the following description and are shown in the drawings and are particularly and distinctly pointed out and set forth in the appended Claims.

Similar numbers refer to similar parts throughout the specification.

DETAILED DESCRIPTION OF THE PREFERRED EMBODIMENTS

Figure 1:
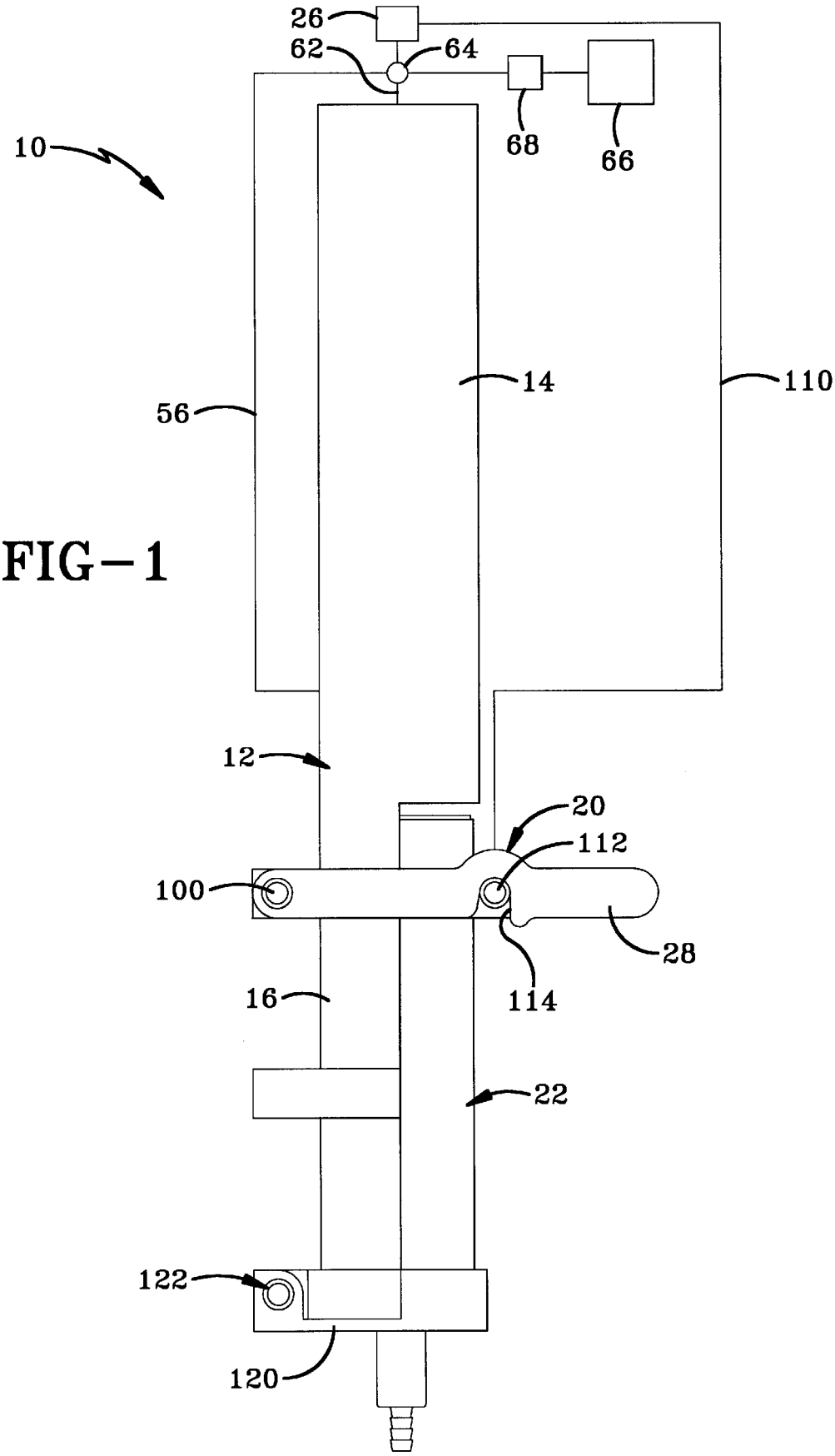
FIG. 1 is a side elevational view of the first embodiment of the high pressure cartridge feed system of the present invention.

The high pressure cartridge feed system of the present invention is indicated generally by the numeral 10 in the accompanying drawings. System 10 includes a base 12 having a first end 14 that houses the ram assembly and a second end 16 that selectively retains the cartridge 18. Second end 16 includes a cradle 22 that receives cartridge 18 and moves between dispensing and loading positions. Cradle 22 may be split into halves 22A and 22B. System 10 further includes a clamping device 20 that is used to lock a cradle 22 in place with respect to base 12.

Figure 2:
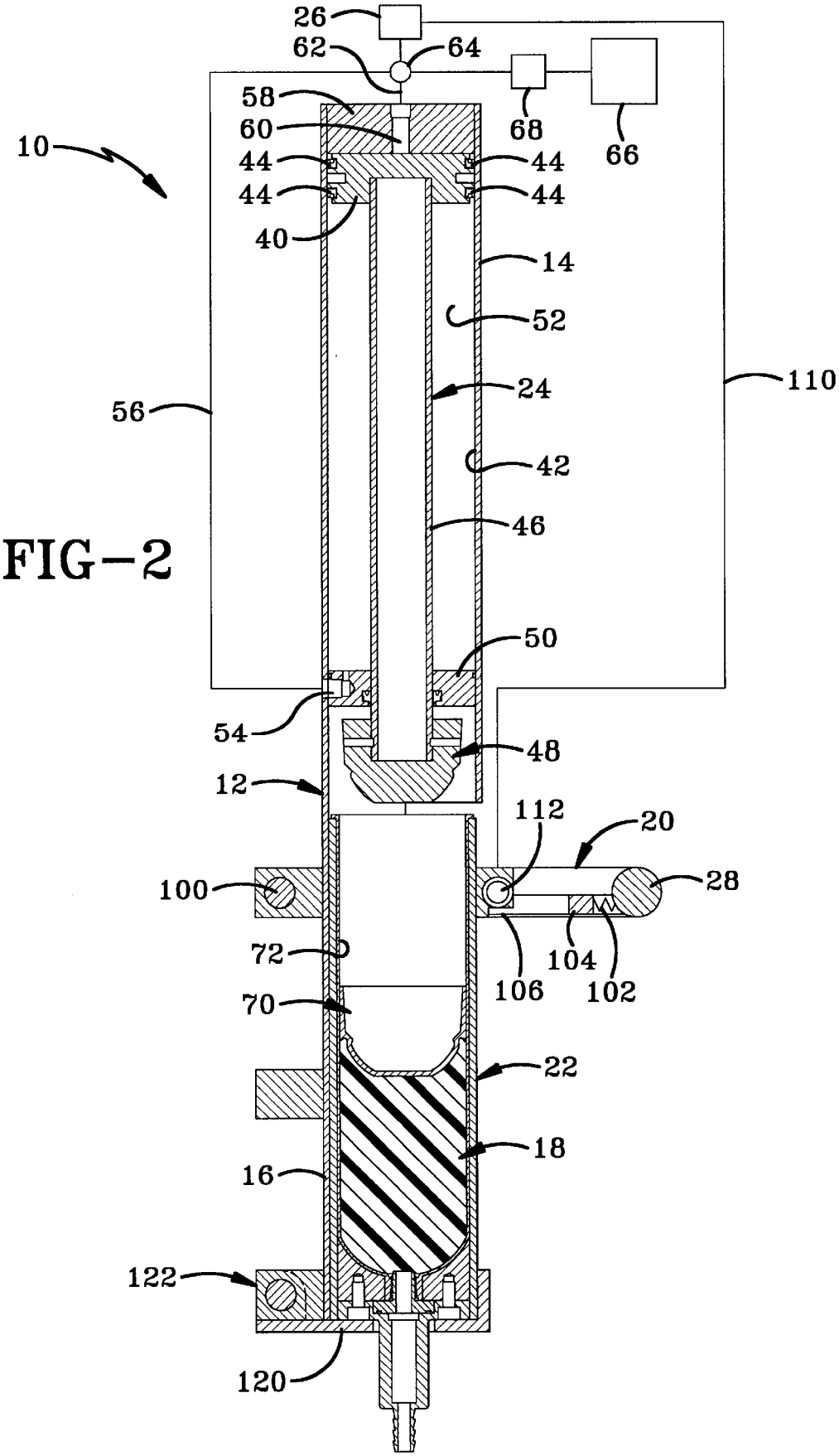
FIG. 2 is a longitudinal sectional view of the system of FIG. 1.

System 10 functions by placing cartridge 18 in cradle 22 and locking cradle 22 in the dispensing position depicted in FIGS. 1 and 2. Clamping device 20 locks cradle 22 in place and positions the sidewall of cradle 22 and base 12 closely adjacent the sidewall of cartridge 18 or actually exerts pressure against cartridge 18. The ram assembly 24 is then actuated by an appropriate switch 26 to dispense the material in cartridge 18. Ram assembly 24 may be configured to create relatively large dispensing pressures because the sidewall of cartridge 18 is securely retained by the walls of cradle 22 and base 12. The walls of cradle 22 and base 12 support the sidewall of cartridge 18 and prevent it from failing when subjected to the relatively high pressure created by ram assembly 24. In the preferred embodiment of the present invention, ram assembly 24 may create zero to 400 pounds per square inch using normal "shop air" pressures (typically 80 pounds per square inch available). The high pressure created in cartridge 18 allows highly viscous materials such as heavy-bodied greases and paste adhesives to be rapidly dispensed. When cartridge 18 is empty, the user deactivates ram assembly 24 with switch 26 and unlocks clamping device 20 by moving the handle 28 of clamping device 20 to the unlocked position depicted in FIG. 3. The user then rotates cradle 22 to the loading position depicted in FIG. 3. The user then removes cartridge 18 from cradle 22 and inserts a new cartridge into system 10.

Ram assembly 24 includes a first piston 40 slidably disposed in a first cylinder 42. First cylinder 42 may be integrally formed with base 12 or may be separately formed and connected to base 12 by appropriate connectors. First piston 40 sealably engages the interior wall of first cylinder 42 and may include a plurality of seals 44 to facilitate the connection. A ram rod 46 extends between first piston 40 and the ram head 48. Ram rod 46 is preferably an elongated member having a hollow cross section to provide strength to ram rod 46. Ram rod 46 is supported adjacent second end 16 of base 12 by a bearing 50 that forms a sealed chamber 52 between bearing 50 and first piston 40. A pneumatic fitting 54 is carried by bearing 50 and provides fluid communication between chamber 52 and a piston return air line 56. An end cap 58 carries a second pneumatic fitting 60 that provides pneumatic communication between a piston driver line 62 and piston 40. Piston driver line 62 and piston return air line 56 are operatively connected to a control valve 64 that is operated and controlled by switch 26. Valve 64 is also connected to a supply of compressed air 66. An air booster 68 is used to achieve high air pressures from standard shop air. Switch 26 and valve 64 allow piston 40 to be driven back and forth by selectively supplying compressed air to chamber 52 and to the end wall of piston 40.

Ram head 48 is configured to substantially match the plunger 70 of cartridge 18 so that a tight seal is created between the internal wall 72 of cartridge 18, plunger 70, and ram head 48 to prevent material inside cartridge 18 from leaking out of cartridge 18 between plunger 70 and wall 72. Ram head 48 specifically includes a leading portion 80 having a curved sidewall 82 that substantially matches the curved sidewall 84 of plunger 70. Ram head 48 further includes a circumferential groove 86 adapted to match the protruding ring 88 of plunger 70. Ram head 48 further includes a stepped and tapered sidewall 90 that substantially matches the stepped and tapered sidewall 92 of plunger 70. In some embodiments of the invention, ram head 48 further includes a seal wall 94 that extends beyond the end 96 of plunger 70 to engage the interior surface of the cartridge sidewall. Ram head 48 increases the effectiveness of the seal between plunger 70 and the sidewall of cartridge 18 by substantially filling the space inside plunger 70 and creating an outwardly directed force from plunger 70 against the sidewall of cartridge 18. This force is immediately counteracted by the wall of cradle 22 and the wall of base 12. This configuration prevents the material disposed in cartridge 18 from leaking out of cartridge 18 between plunger 70 and the sidewall of cartridge 18.

Figure 5:
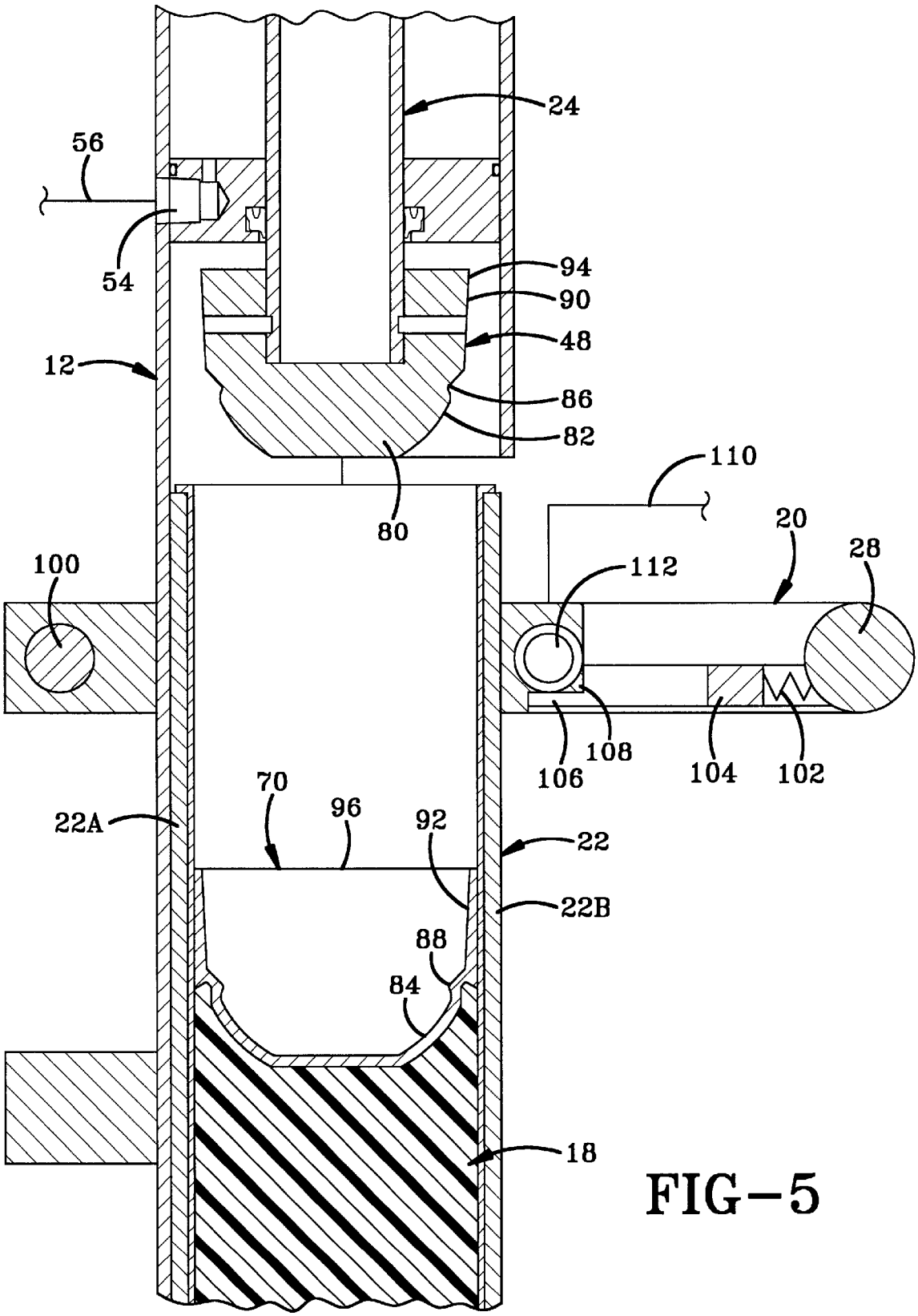
FIG. 5 is an enlarged sectional view of the plunger, the ram head, and the clamping device of the first embodiment of the invention

Clamping device 20 is pivotally connected to base 12 by a hinge pin 100. Clamping device 20 includes a spring 102 (FIG. 5) that is connected to a locking member 104. Locking member 104 includes a ledge 106 that slides under a block 108 when handle 28 is in the locked position. The user must pull member 104 back towards the end of handle to compress spring 102 to remove ledge 106 before handle 28 can be moved to the unlocked position. Handle 20 is configured to apply a compressive force to cradle 22 to firmly clamp cartridge 18 in the dispensing position depicted in FIGS. 1, 2, and 5. Clamping device 20 may further in communication with switch 26 by a sensor line 110. Sensor line 110 is connected to an appropriate sensor that will prevent switch 26 from activating ram assembly 24 when clamping device 20 is not in the locked position. Clamping device 20 includes a pin 112 that fits within a slot 114 on handle 28 when clamping device 20 is in the locked position. Pin 112 is connected to block 108 which is, in turn, connected to cradle 22 to create the clamping force on cartridge 18.

Figure 3:
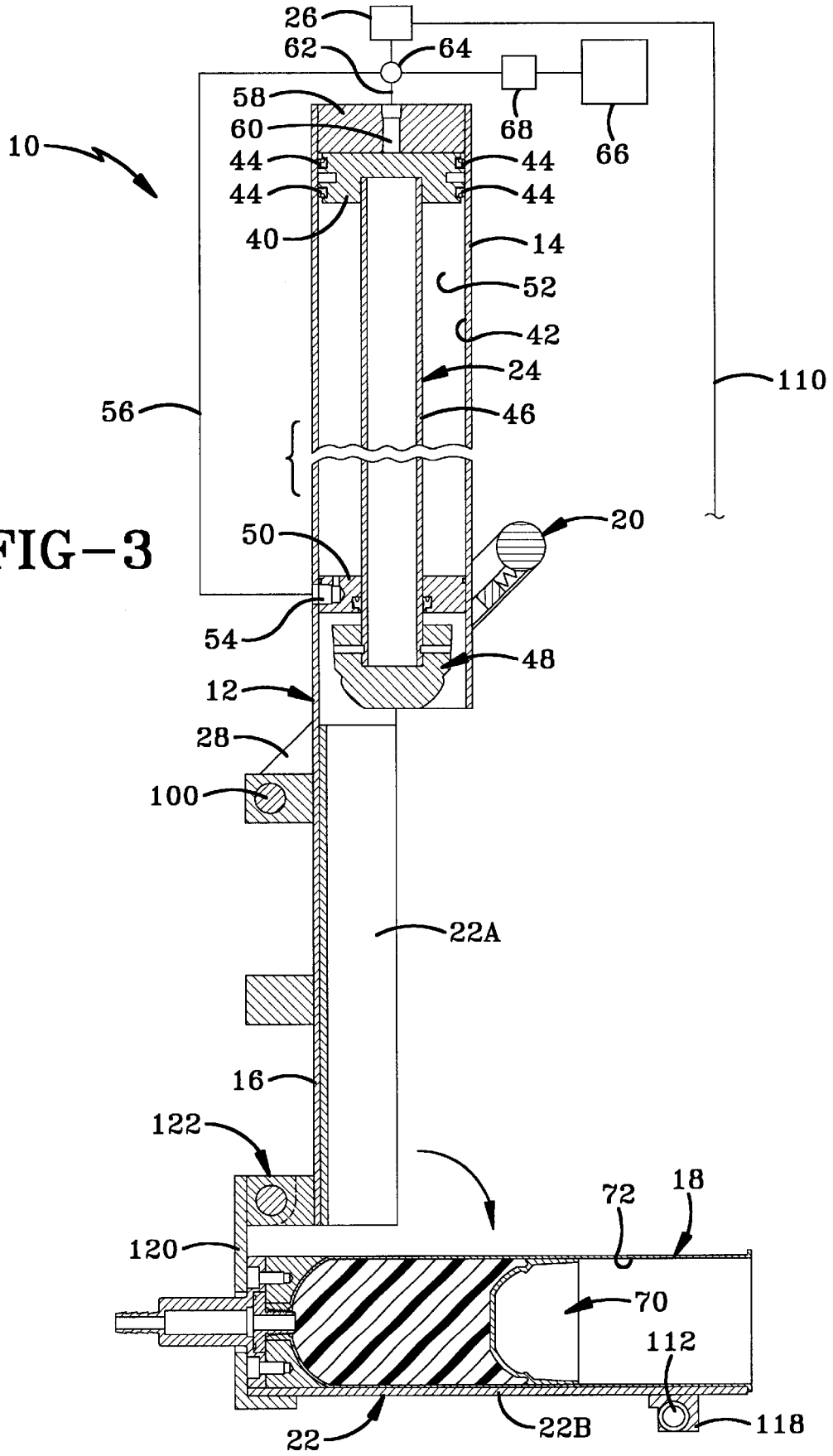
FIG. 3 is a view similar to FIG. 2 showing the system in the open position.
Figure 4:
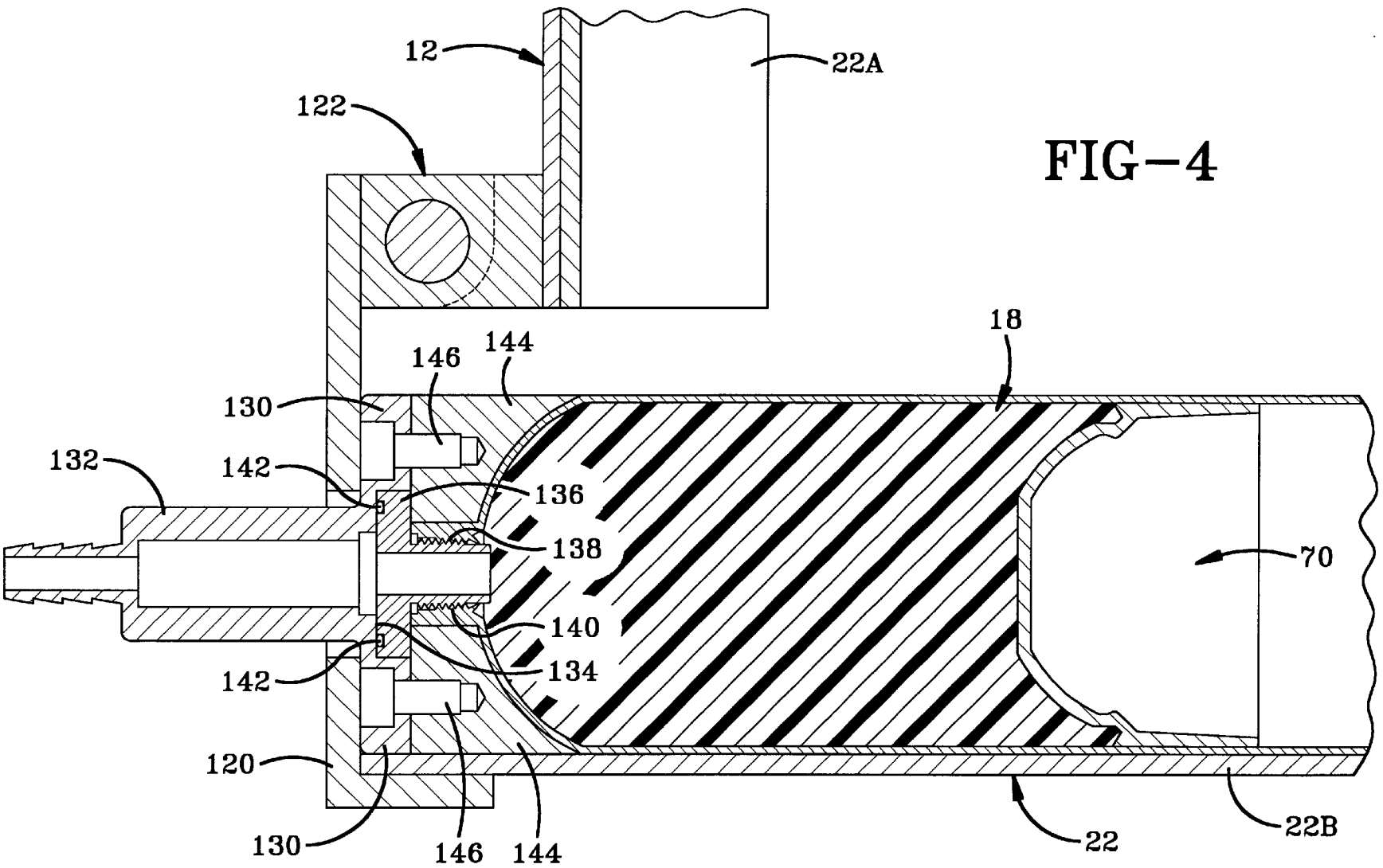
FIG. 4 is an exploded sectional view of the outlet port fitting of the system of the first embodiment of the present invention.

Cradle 22 is mounted to a hinge member 120 that is connected to base 12 by an appropriate hinge 122 that allows cradle 22 to be pivoted from the dispensing position depicted in FIGS. 1 and 2 to the loading and unloading position depicted in FIG. 3. It is desired that the loading and unloading position be positioned at least 90° down from the dispensing position as depicted in FIG. 3. Of course, the loading position may be less than 90° in other embodiments of the invention.

Cradle 22 includes a first block 130 having a dispensing nipple 132. Block 130 has an interior depression 134 that receives a fitting 136 that has external threads 138 that mate with the internal threads 140 of cartridge 18. Fitting 136 includes a seal 142 that seats against the inner surface of block 130. Block 130 is connected to a cartridge seat 144 that has an inner surface curved to match the front surface of cartridge 18. The connection is formed with a pair of bolts 146 that threadedly engage seat 144.

Figure 6:
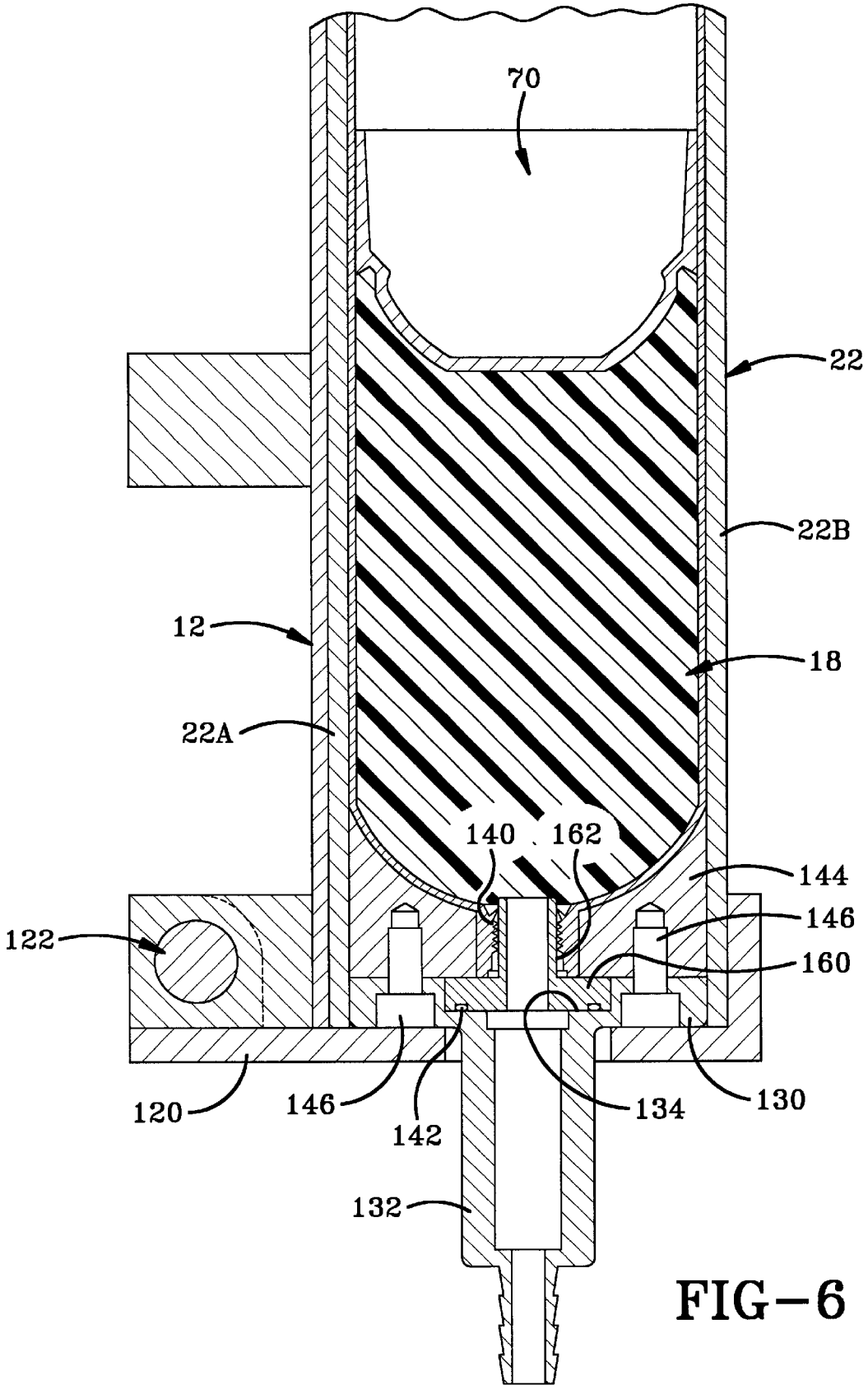
FIG. 6 is an enlarged view of the second end of the base showing a second embodiment of the invention.
Figure 7:
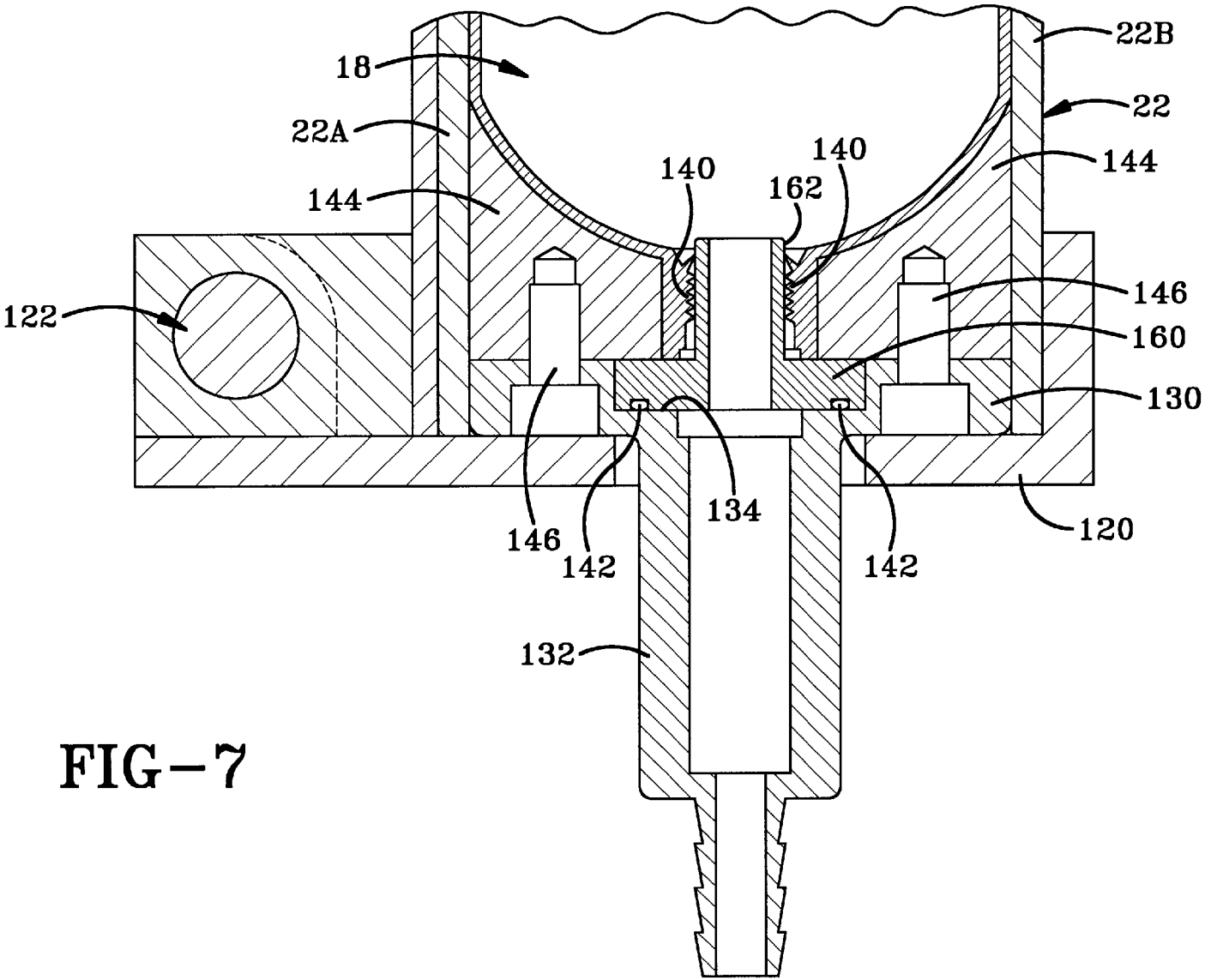
FIG. 7 is an enlarged view of the end of the second end of the base showing the connection between the threaded post of the cartridge and the outlet port fitting.

A second embodiment of the invention is depicted in FIGS. 6 and 7. The second embodiment includes most of the same elements as system 10 except that the fitting 160 includes a smooth outer surface 162 that may be slid into and out of the threaded port of cartridge 18 quickly and easily. This allows cartridge 18 to be quickly and easily changed because fitting 160 does not have to be unthreaded from cartridge 18. A threaded connection between fitting 160 and cartridge 18 is not necessary because of seal 142 and the interference fit between fitting 160 and block 130.

The third embodiment of the cartridge dispensing system is indicated generally by the numeral 200 in FIGS. 8 through 16. System 200 includes a base 212 having a first end 214 that carries the ram and a second end 216 that selectively retains a cartridge 218. Second end 216 includes a cradle 222 that receives cartridge 218 and moves between dispensing and loading positions.

Figure 8:
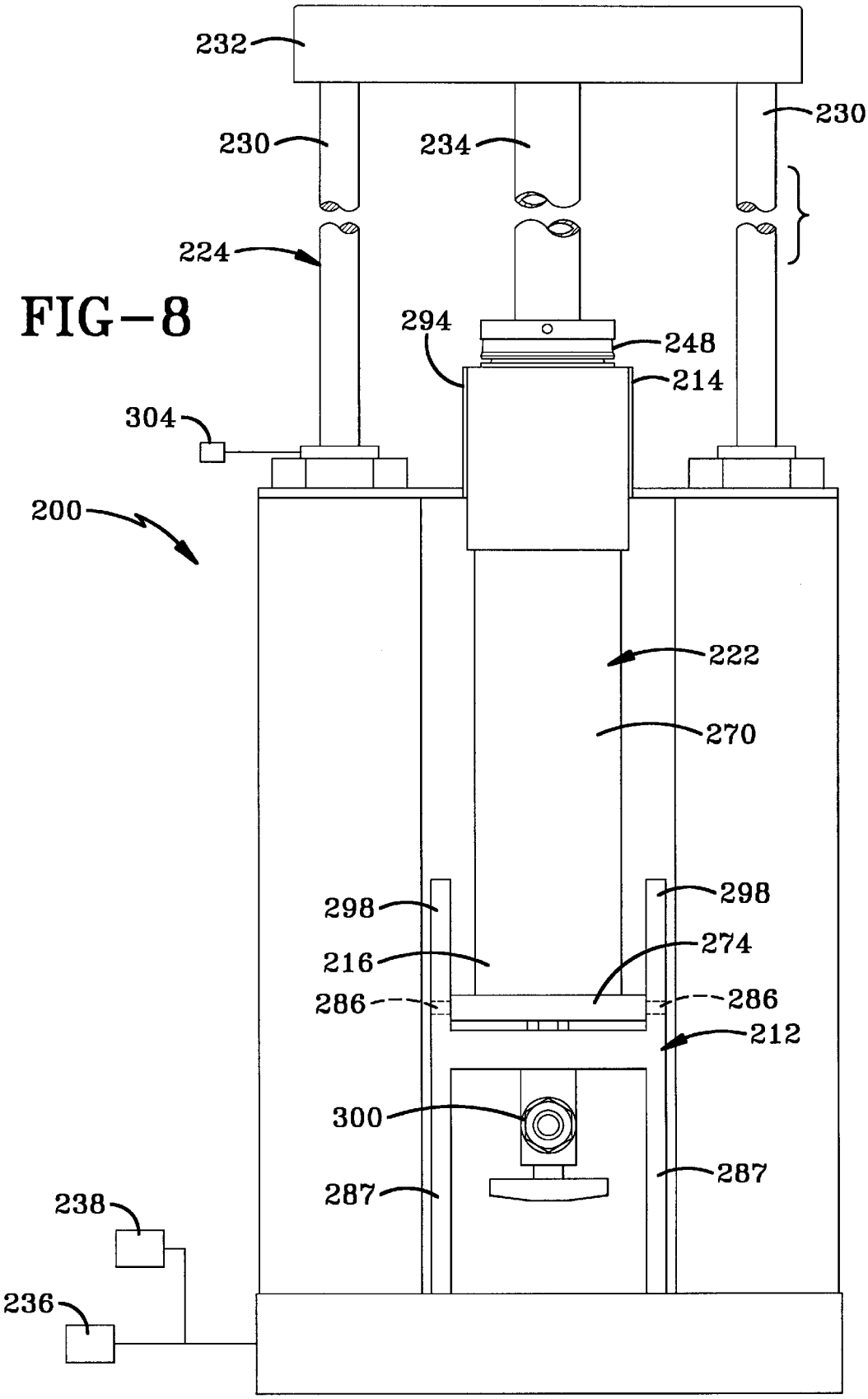
FIG. 8 is a front elevation view of the third embodiment of the high pressure cartridge feed system of the present invention.
Figure 9:
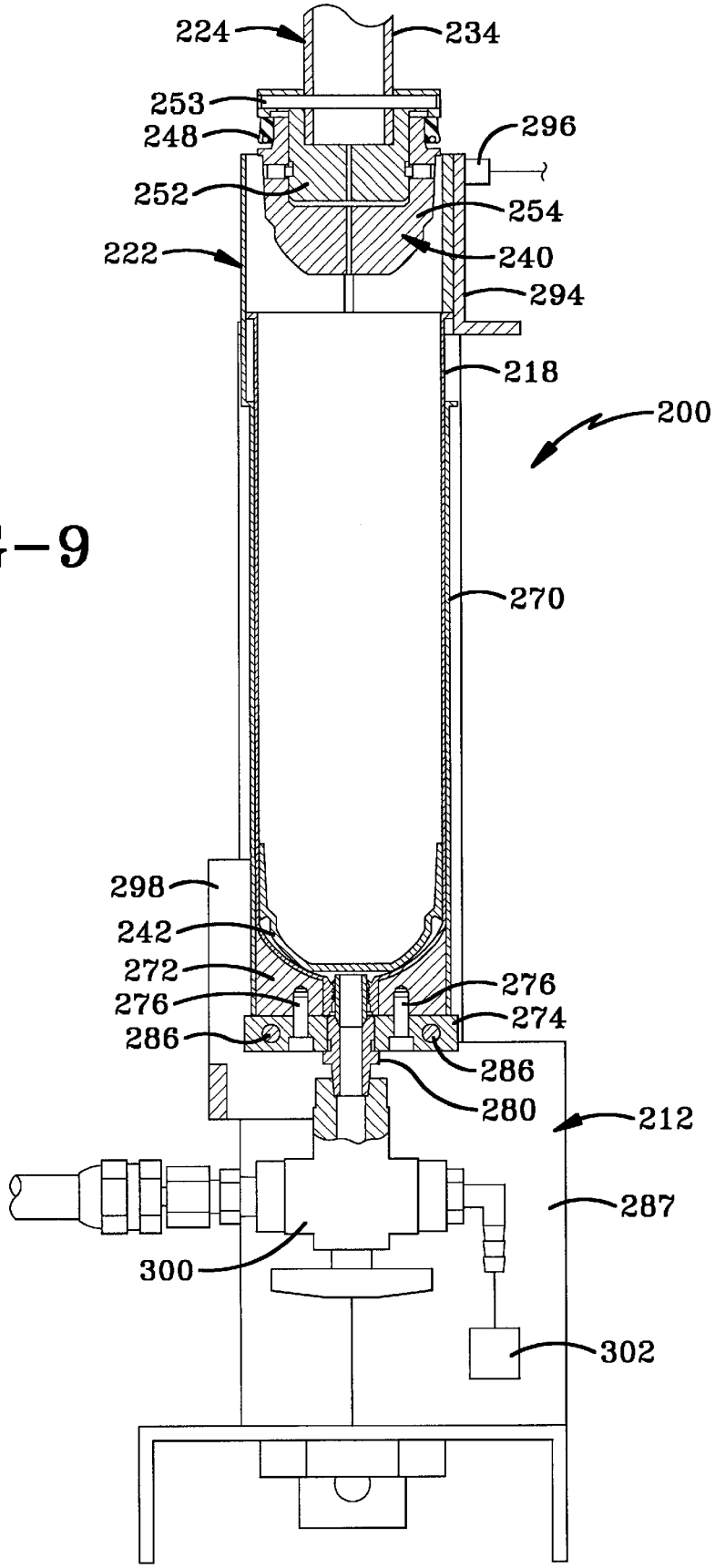
FIG. 9 is a side view of FIG. 8 shown partially in section.
Figure 16:
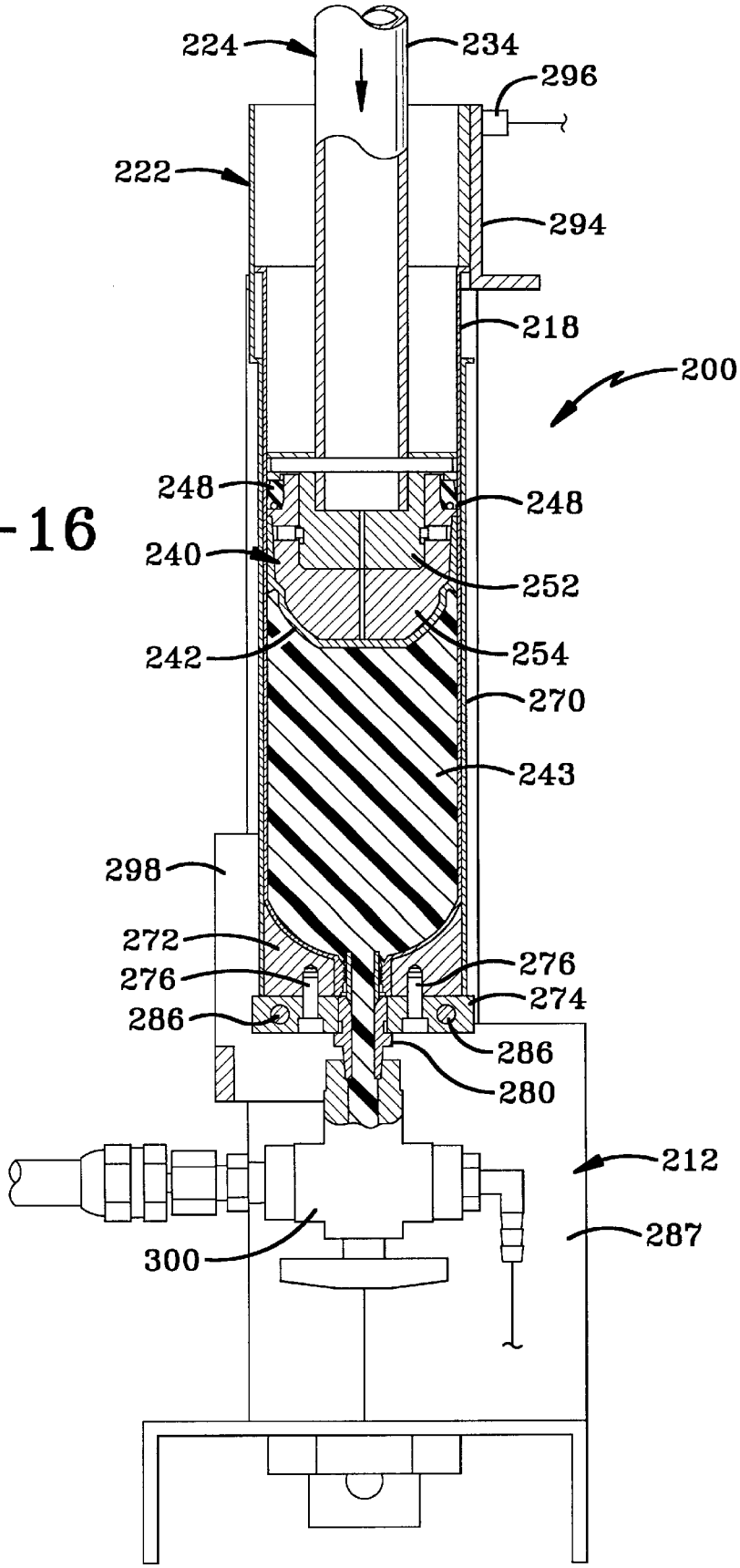
FIG. 16 is a section view of material being dispensed out of a material cartridge loaded into the system of the invention.

System 200 is used by placing cartridge 218 in cradle 222 and moving cradle 222 to the dispensing position depicted in FIGS. 8, 9, and 16. The sidewall of cradle 222 is disposed closely adjacent the sidewall of cartridge 218 to support the sidewall of cartridge 218 at the high dispensing pressures generated by system 200. A ram assembly 224 is then actuated by an appropriate switch to dispense the material in cartridge 218. Ram assembly 224 may be configured to create relatively large dispensing pressures because the sidewall of cartridge 218 is securely retained by the walls of cradle 222. The high dispensing pressures allow system 200 to rapidly dispense viscous material.

Ram assembly 224 includes a drive mechanism such as the preferred pair of linear actuators 226 and 228 disposed on either side of base 212. Each actuator 226 and 228 may be pneumatic, hydraulic, or mechanical depending on the application in which system 200 is to be used. The actuation rod 230 of each actuator 226/228 is connected to a bridge 232 that is attached to the ram rod 234. Actuators 226 and 228 cooperate to drive rod 234 back and forth relative to base 212. Actuators 226 and 228 are disposed next to cradle 222 in order to reduce the overall height of system 200.

Each actuator 226/228 is connected to an appropriate source 236 of fluid or power as required by the type of actuator 226/228. A controller 238 is adapted to selectively drive actuators 226/228. Controller 238 includes at least three positions: a first position that causes actuators 226/228 to drive ram rod 234 toward base 212 (a dispensing direction); a second neutral position; and a third position that causes actuators 226/228 to drive ram rod 234 away from base 212. Controller 238 may include a three position, four-way valve having an "open center" position to allow the neutral position to be achieved. The neutral position allows cartridge 218 to be depressurized without removing ram rod 234 thus not breaking the seal between the ram head 240 and cartridge 218. The neutral position also saves time because ram rod 234 does not have to be moved out of cartridge 218 each time cartridge 218 is depressurized.

As described above in the first embodiment of the invention, cartridge 218 includes a plunger 242 that seals the open end of cartridge. Ram head 240 of the invention is configured to cooperate with plunger 242 to tightly seal the open end of cartridge 218 so that material 243 is not forced back over plunger 242 and ram head 240 during dispensing. Plunger 242 includes an annular lip 244 that extends downwardly at the lower end of a sealing surface 246. Annular lip 244 and sealing surface 246 frictionally engage the inner surface of cartridge 218 to prevent material 243 from being squeezed out the open end of cartridge. Plunger 242 is designed to work at relatively low dispensing pressures and can fail when subjected to the high pressure created by actuators 226/228.

Ram head 240 is thus configured to help seal the open end of cartridge 218 by cooperating with plunger 242 and by providing an annular seal 248 that engages the inner surface of cartridge 218. Annular seal 248 includes a stiffener 250 that is preferably embedded within the body of annular seal 248. Annular seal 248 is preferably fabricated from a rubber or polymer material or other suitable material adapted to be used in sealing applications. Stiffener 250 may be fabricated from any of a variety of materials known to those skilled in the art.

Annular seal 248 is carried by a ram base 252 that is connected to ram rod 234. Ram base 252 may be preferably connected with a pin 253. A ram nose 254 is movably carried by ram base 252 between disengaged (FIGS. 9 and 13) and engaged (FIGS. 15 and 16) positions. Ram nose 254 defines an outwardly tapered, annular surface 256 disposed inward of annular seal 248. When ram nose is in the engaged position, tapered surface 256 engages annular seal 248 to force it slightly outwardly against the inner surface of cartridge 218. When ram head 240 is being moved back out of cartridge 218, nose 254 moves to the disengaged position to release the force on annular seal 248 to allow it to be removed from cartridge 218.

Ram nose 254 is carried on ram base 252 with fingers 258 that slidably engage a slot 260 formed in base 252. Ram nose 254 and ram base 252 each define an air passageway 262 that is in fluid communication with the interior of ram rod 234. Air passageway 262 allows ram nose 254 to be separated from plunger 242 when ram head 240 is being removed from cartridge 218. Air passageways 262 are in selective fluid communication with a source of pressurized air 264 that applies the pressurized air between nose 254 and plunger 242 as well as between base 252 and nose 254. The air may be applied automatically or manually as desired.

Cartridge 218 is held in cradle 222. Cradle 22 includes a retaining sleeve 270 having an inner diameter slightly larger than the outer diameter of cartridge 218 so that retaining sleeve 270 supports the sidewall of cartridge 218 allowing high dispensing pressures to be used without rupturing the sidewall of cartridge 218. A concave cartridge seat 272 is disposed at the bottom of cradle 222. Seat 272 is configured to match the curvature of the front of cartridge 218 so that the front of cartridge does not collapse when subjected to high dispensing pressure. Seat 272 is mounted on a cradle base 274 by a plurality of suitable connectors 276.

A fitting 280 is carried by base 274 and projects inwardly to receive the dispensing end of cartridge 218. Fitting 280 is preferably threaded into base 274. Fitting 280 includes an insert portion 282 (FIG. 12) having a smooth outer surface configured to slidably engage the internal threads 284 of cartridge 218. Insert portion 282 allows cartridge 218 to be quickly installed in cradle 22 without having to screw cartridge 218 onto a threaded connector.

Base 274 includes a pair of mounting pins 286 that are used to mount cradle on base 212. Base 212 includes first and second spaced supports 287 that each define a notch 288 and a landing 290 that receive pins 286. Cradle base 274 preferably fits between supports 287 with pins 286 projecting out from opposite sides of cradle base 274. Landing 290 preferably includes an edge wall 292 that supports the side of the pin 286 disposed on landing 290. Pins 286 rest on supports so that cradle can be lifted off of base 212 without disconnecting any connectors or locking mechanisms. The removability of cradle 222 allows cartridge 218 to be removed from base 212 without disconnecting cartridge 218 from fitting 280. In some applications, the removability allows cartridge to be refrigerated when it is not in use.

Figures 10, 10A:
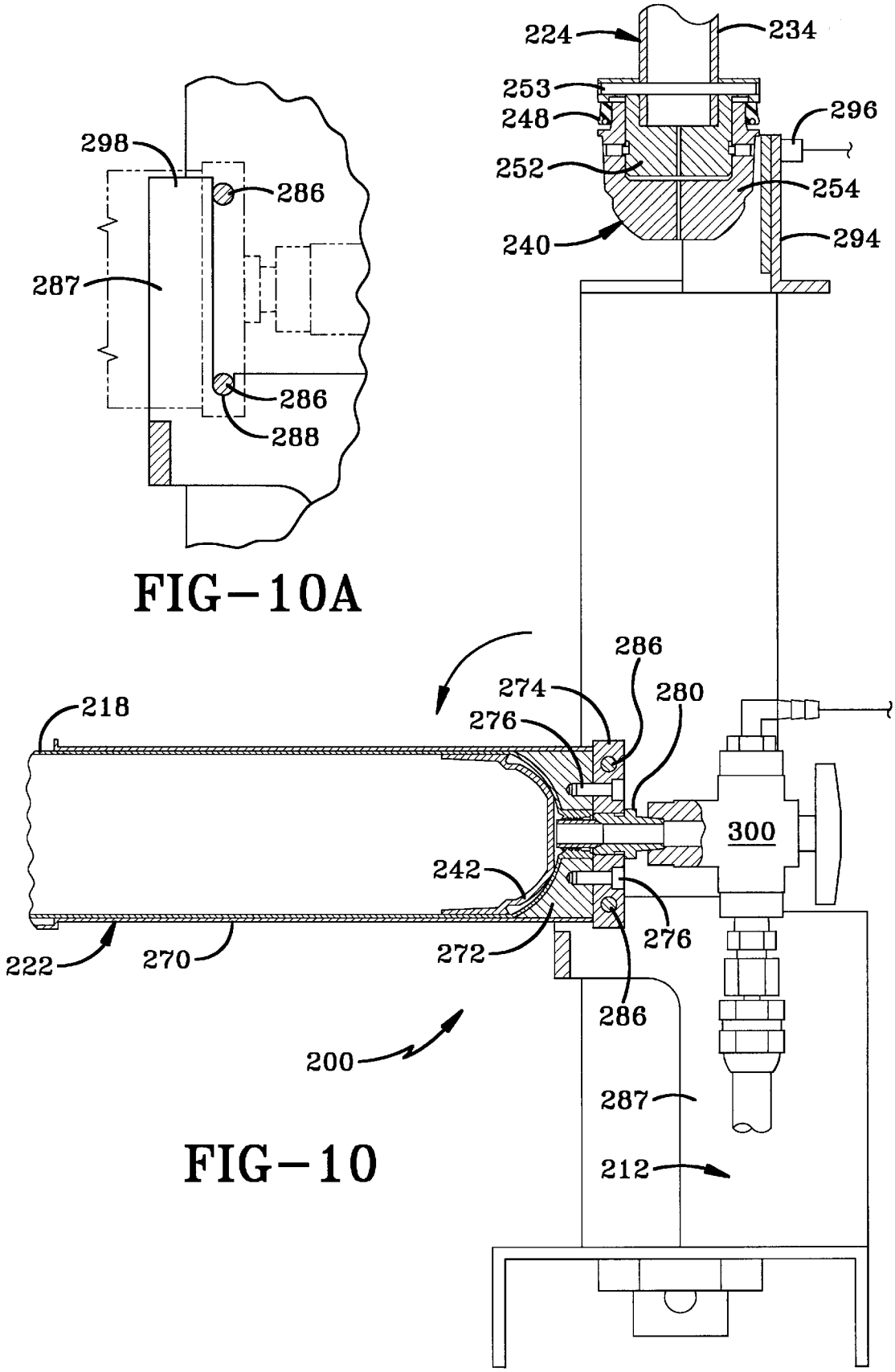
FIG. 10 is view similar to FIG. 9 with the system in the open position.
FIG. 10A is an enlarged elevation view of the connection between the base and the cradle.
Figure 11:
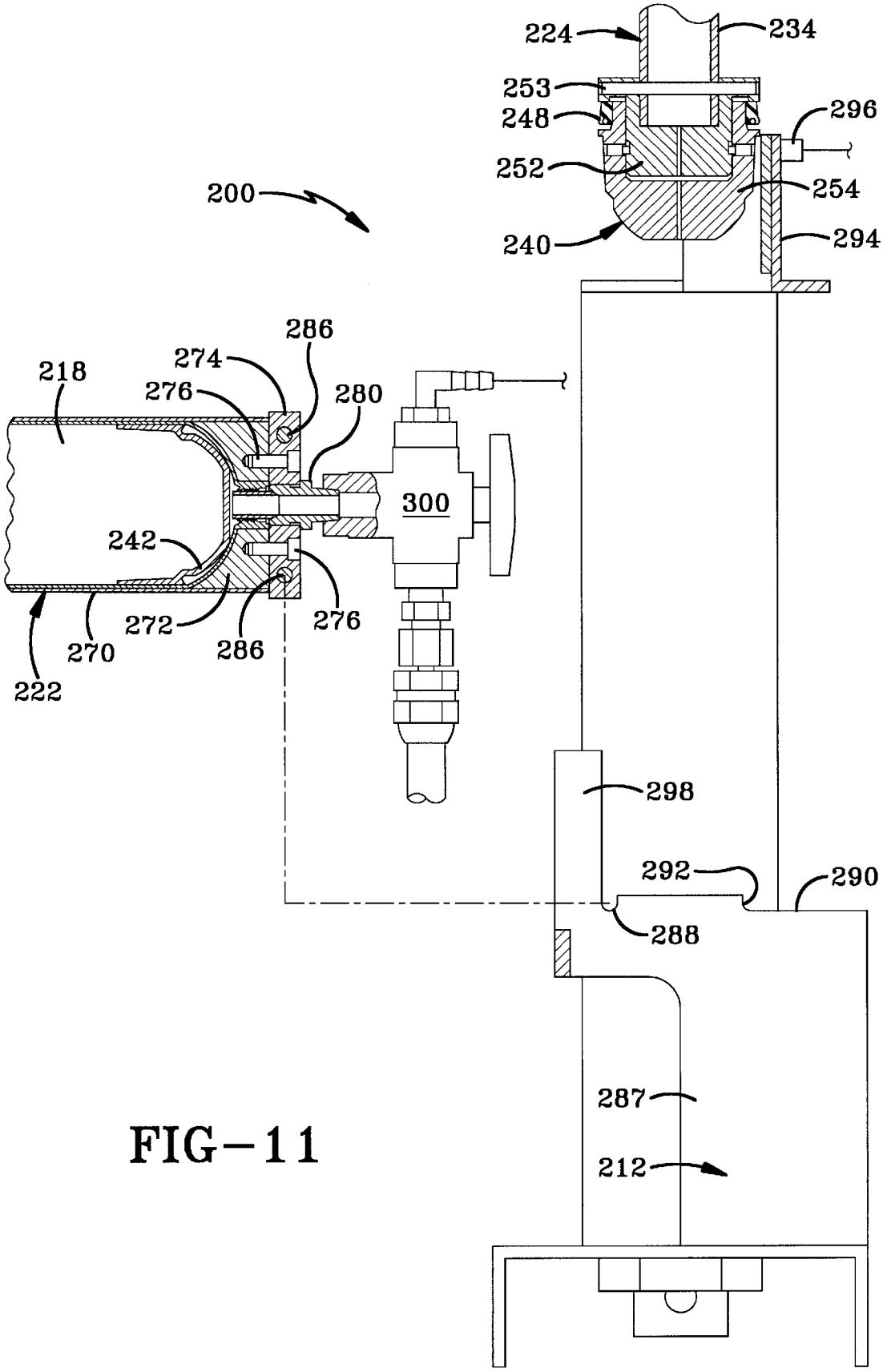
FIG. 11 is a view similar to FIG. 10 showing the cradle removed from the base.
Figure 12:
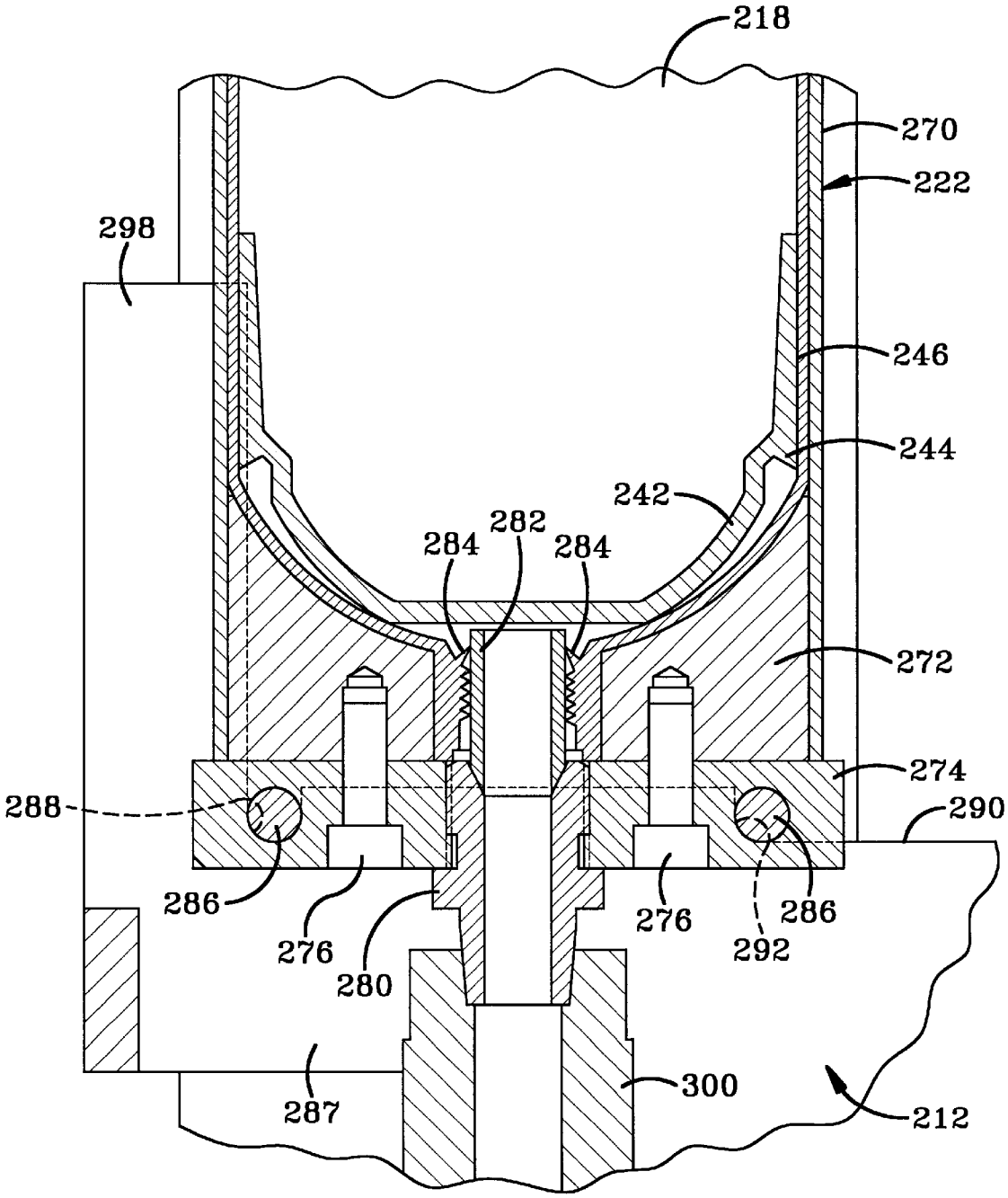
FIG. 12 is an enlarged section view of the end of the cradle and base
Figure 15:
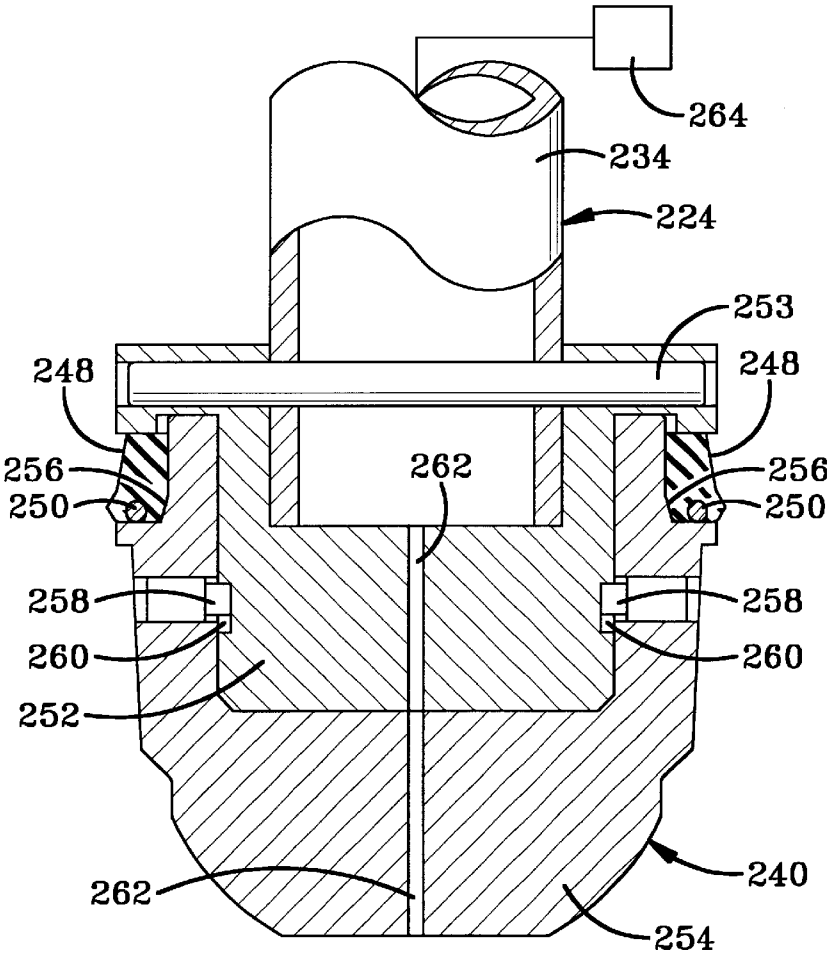
FIG. 15 is an enlarged section view of the ram in an engaged position.
Figure 13:
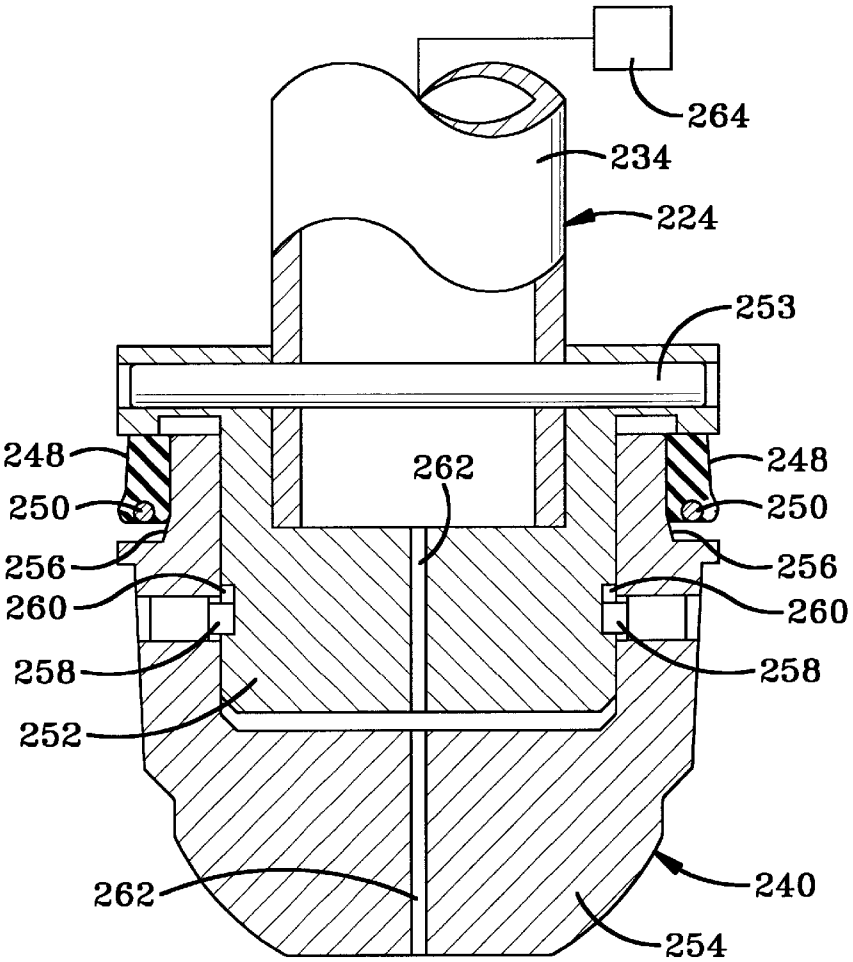
FIG. 13 is an enlarged section view of the ram in an unengaged position.

Pins 286 allow cradle 222 to pivot with respect to base 212. Base 212 may include a stop 294 that prevents cradle 22 from pivoting in one direction. A sensor 296 may be connected to stop 294. Sensor 296 is configured to create an indication signal when cradle 222 is in the upright dispensing position depicted in FIG. 16. The indication signal may be used by controller 238 to prevent ram assembly 224 movement unless cradle 222 is properly positioned. Supports 287 include extension portions 298 that engage pins 286 when cradle 222 is pivoted down 90 degrees from vertical as shown in FIG. 10A. The configuration of portions 298 define how far cradle 222 may be pivoted and define the loading/unloading position of cradle 222.

A three way coupling 300 is preferably connected to fitting 280. One of the openings of coupling 300 is preferably connected to a source of pressurized air 302 so that material 243 may be purged out of the system after cartridge 222 is changed. System 200 may also include a sensor 304 that monitors the position of ram rod 234 or ram assembly 224 so that the user will know how much material 243 remains in cartridge 218.

Figure 14:
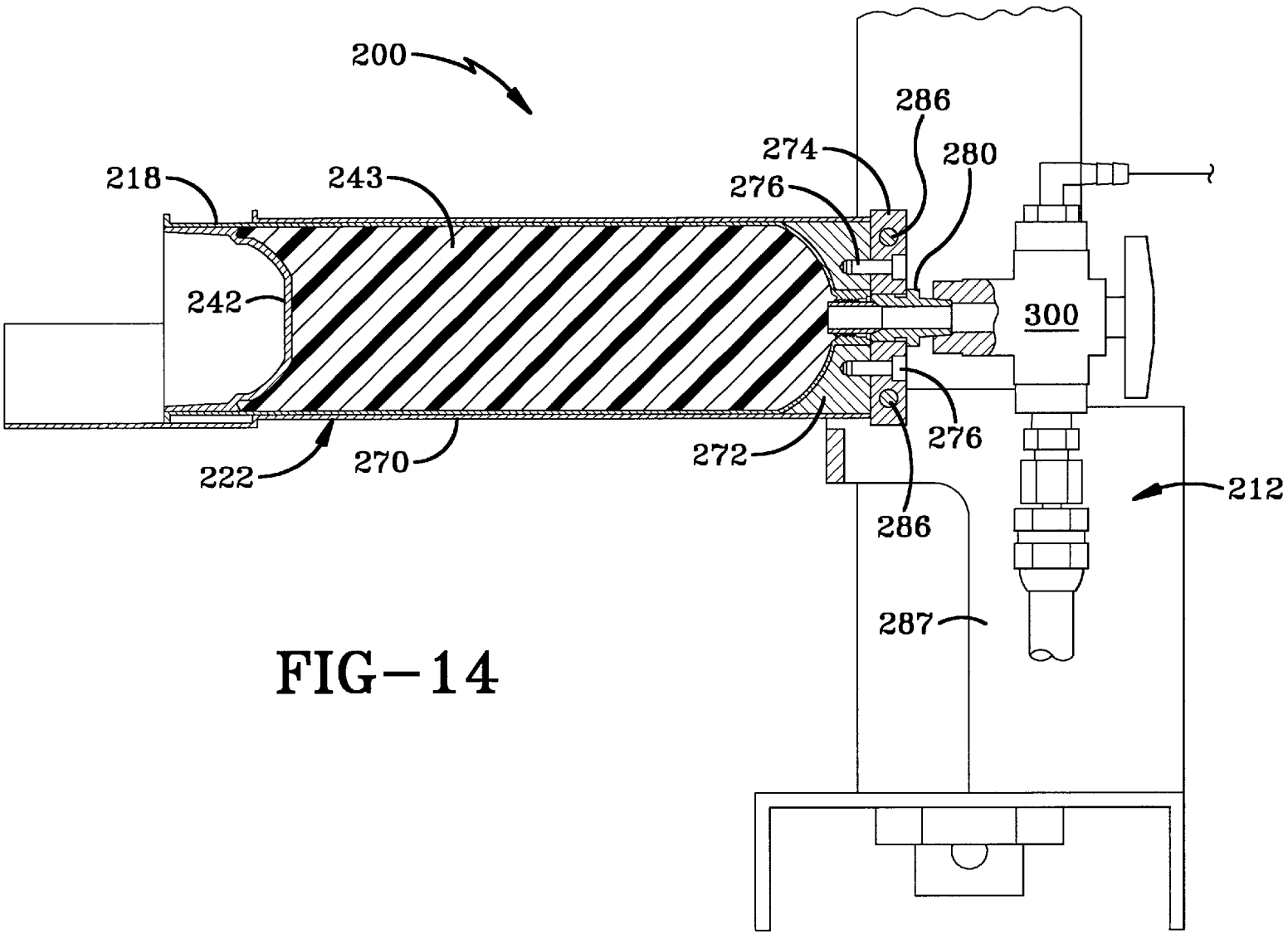
FIG. 14 is a section view of a material cartridge being loaded into the cradle.

System 200 is used by first opening cradle 222 to the loading position. A loaded cartridge 218 is placed into cradle 222 and pushed down until cartridge 218 slides over insert portion 282 of fitting 280 as shown in FIG. 14. Cradle 222 is then pivoted upwardly to the dispensing position depicted in FIG. 16. Sensor 296 creates an indication signal that allows ram assembly 224 to be used.

The user then activates ram assembly 224 to cause ram head 240 to move down to engage plunger 242. As force is applied to ram head 240 to force it into plunger 242, ram nose 254 moves to the engaged position to force annular seal 248 outwardly to engage the inner surface of cartridge 218. The user may then control ram assembly 224 to dispense material 243 from cartridge 218.

When the user desires to change cartridges 218 or store cartridge 218 in another location, the user removes ram assembly 224 from cartridge at which time air pressure is applied to passageways 262 to release nose 254 from plunger 242. Ram head 240 may then be removed from cartridge 218 and cradle 222 may be pivoted down to the loading position.

Accordingly, the improved high pressure cartridge feed system apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the high pressure cartridge feed system is constructed and used, the characteristics of the construction, and the advantageous new and useful results obtained; the new and useful structures, devices, elements, arrangements, parts, and combinations are set forth in the appended claims.

What is claimed is:

1. A cartridge dispensing system for dispensing material out of a cartridge, the system comprising:

a base;

a ram assembly including at least one linear actuator and a ram head;

a cradle carried by the base; the cradle being movable between dispensing and loading positions;

the cradle adapted to hold the cartridge;

the linear actuator adapted to cause the ram head to engage the cartridge and push material out of the cartridge; and a sensor that indicates the position of the cradle.

2. The system of claim 1, wherein the cradle is movable between dispensing and loading positions.

3. The system of claim 2, wherein the cradle pivots between the dispensing and loading positions.

4. The system of claim 3, wherein the cartridge is disposed substantially vertical in the dispensing position and substantially horizontal in the loading position.

5. The system of claim 1, wherein the cradle is divided into two longitudinal portions that are adapted to be disposed on opposite sides of the cartridge.

6. A cartridge dispensing system for dispensing material out of a cartridge, the system comprising:

a base;

a ram assembly including at least one linear actuator and a ram head;

a cradle carried by the base;

the cradle adapted to hold the cartridge;

the linear actuator adapted to cause the ram head to engage the cartridge and push material out of the cartridge;

the cradle being divided into two longitudinal portions that are adapted to be disposed on opposite sides of the cartridge; and a clamp that forces the two longitudinal halves of the cradle toward each other.

7. The system of claim 6, further comprising a spring-biased lock on the clamp.

8. The system of claim 1, wherein the cartridge includes a cylindrical wall portion and the cradle includes a cylindrical wall adapted to fit snugly around the cylindrical wall portion of the cartridge to support the cylindrical wall portion of the cartridge at high dispensing pressures.

9. The system of claim 1, further comprising a seat adapted to support the front portion of the cartridge; the cartridge including a threaded port and the system further comprising a fitting having an unthreaded outer surface; the threaded port of the cartridge adapted to slide over the unthreaded outer surface of the fitting when the cartridge is loaded into the cradle.

10. A cartridge dispensing system for dispensing material out of a cartridge, the system comprising:

a base;

a ram assembly including at least one linear actuator and a ram head;

a cradle carried by the base;

the cradle adapted to hold the cartridge;

the linear actuator adapted to cause the ram head to engage the cartridge and push material out of the cartridge;

a seat adapted to support the front portion of the cartridge; and the cartridge including a threaded port and the system further comprising a fitting having an unthreaded outer surface; the threaded port of the cartridge adapted to slide over the unthreaded outer surface of the fitting when the cartridge is loaded into the cradle.

11. The system of claim 10, further comprising a controller adapted to control the linear actuator to drive ram assembly up and down.

12. The system of claim 11, wherein the controller includes a neutral position.

13. The system of claim 10, wherein the ram head includes a seal adapted to engage the cartridge.

14. A cartridge dispensing system for dispensing material out of a cartridge, the system comprising:

a base;

a ram assembly including at least one linear actuator and a ram head;

a cradle carried by the base;

the cradle adapted to hold the cartridge;

the linear actuator adapted to cause the ram head to engage the cartridge and push material out of the cartridge;

the ram head including a seal adapted to engage the cartridge; and the ram head including a ram base that carries the seal and a ram nose that is movable between engaged and disengaged positions; the ram nose defining a tapered surface adjacent the seal; the tapered surface forcing the seal outwardly when the ram nose is moved to the engaged position.

15. A cartridge dispensing system for dispensing material out of a cartridge, the system comprising:

a base;

a ram assembly including at least one linear actuator and a ram head;

a cradle carried by the base;

the cradle adapted to hold the cartridge;

the linear actuator adapted to cause the ram head to engage the cartridge and push material out of the cartridge; and the ram head defining an air passageway adapted to allow air to be delivered between the ram head and the cartridge.

16. A cartridge dispensing system for dispensing material out of a cartridge, the cartridge including a cylindrical wall having an open end; the system comprising:

a base;

a ram assembly including a ram head adapted to fit within the open end of the cartridge;

the ram head including an annular seal adapted to seal the open end of the cartridge;

the ram head including a ram base that carries the annular seal and a ram nose that is movable between engaged and disengaged positions;

a cradle carried by the base;

the cradle adapted to hold the cartridge;

the ram assembly adapted to cause the ram head to engage the cartridge and push material out of the cartridge; and the ram nose defines a tapered surface adjacent the annular seal; the tapered surface forcing the annular seal outwardly when the ram nose is moved to the engaged position.

17. A cartridge dispensing system for dispensing material out of a cartridge, the system comprising:

a base;

a ram assembly a ram head;

a cradle carried by the base;

the cradle adapted to hold the cartridge;

the cradle pivoting between dispensing and loading positions;

the ram assembly adapted to cause the ram head to engage the cartridge and push material out of the cartridge; and the cradle including a pair of pins that are placed on the base to mount the cradle on the base.

18. The system of claim 17, wherein the cradle is removable from the base.

19. The system of claim 18, wherein the cartridge is disposed substantially vertical in the dispensing position and substantially horizontal in the loading position.

20. The system of claim 17, further comprising a seat adapted to support the front portion of the cartridge.

21. The system of claim 20, wherein the cartridge includes a threaded port and the system further comprises a fitting having an unthreaded outer surface; the threaded port of the cartridge adapted to slide over the unthreaded outer surface of the fitting when the cartridge is loaded into the cradle.

22. The system of claim 12, wherein the ram head includes a ram base that carries the seal and a ram nose that is movable between engaged and disengaged positions; the ram nose defining a tapered surface adjacent the seal; the tapered surface forcing the seal outwardly when the ram nose is moved to the engaged position.

23. The system of claim 15, wherein the ram head includes a seal adapted to engage the cartridge; and the ram head including a ram base that carries the seal and a ram nose that is movable between engaged and disengaged positions; the ram nose defining a tapered surface adjacent the seal; the tapered surface forcing the seal outwardly when the ram nose is moved to the engaged position.

24. A cartridge dispensing system for dispensing material out of a cartridge; the cartridge including a threaded port; the system comprising:

a base;

a ram assembly including a ram head;

a cradle carried by the base;

the cradle adapted to hold the cartridge;

the ram head adapted to engage the cartridge and push material out of the cartridge; and a seat adapted to support the front portion of the cartridge; and a fitting having an unthreaded outer surface; the threaded port of the cartridge adapted to slide over the unthreaded outer surface of the fitting when the cartridge is loaded into the cradle.

25. A cartridge dispensing system for dispensing material out of a cartridge; the cartridge including a threaded port; the system comprising:

a base;

a ram assembly including a ram head;

a cradle carried by the base;

the cradle adapted to hold the cartridge;

the ram head adapted to engage the cartridge and push material out of the cartridge; and the ram head defining an air passageway adapted to allow air to be delivered between the ram head and the cartridge.

* * * * *